United States Patent [19]

Oberheim et al.

[11] 4,020,671

[45] May 3, 1977

[54] PRESS FOR THE SHAPING OF SHEET METAL WITHOUT CUTTING

[75] Inventors: Heinz Oberheim; Johann Katzer, both of Lohfelden, Germany

[73] Assignee: IWK Pressen GmbH, Germany

[22] Filed: Aug. 8, 1975

[21] Appl. No.: 603,032

[30] Foreign Application Priority Data

Aug. 10, 1974 Germany ..... 2438494

[52] U.S. Cl. ..... 72/450; 72/455; 72/456; 100/214

[51] Int. Cl.[2] ..... B21J 13/04

[58] Field of Search ..... 72/450, 455, 456; 100/214

[56] References Cited

UNITED STATES PATENTS

| | | | |
|---|---|---|---|
| 1,356,748 | 10/1920 | Smith | 72/450 |
| 2,084,066 | 6/1937 | Rode | 72/450 |
| 2,652,770 | 9/1953 | Wilkins | 100/214 |
| 3,408,849 | 11/1968 | Jetschmann | 72/456 |
| 3,802,248 | 4/1974 | Ross | 72/455 |

*Primary Examiner*—C.W. Lanham
*Assistant Examiner*—Gene P. Crosby
*Attorney, Agent, or Firm*—McGlew and Tuttle

[57] ABSTRACT

A press for the non-cutting shaping of sheet metal and similar materials comprises a closed frame which is connected at the end to the press plunger guided for vertical movement and the frame being connected at its opposite end at respective corners to cranks which are rotatable in respective opposite directions. In addition the frame side adjacent the rotating cranks is guided by rollers engaged against respective opposite sides of a fixed guide.

5 Claims, 1 Drawing Figure

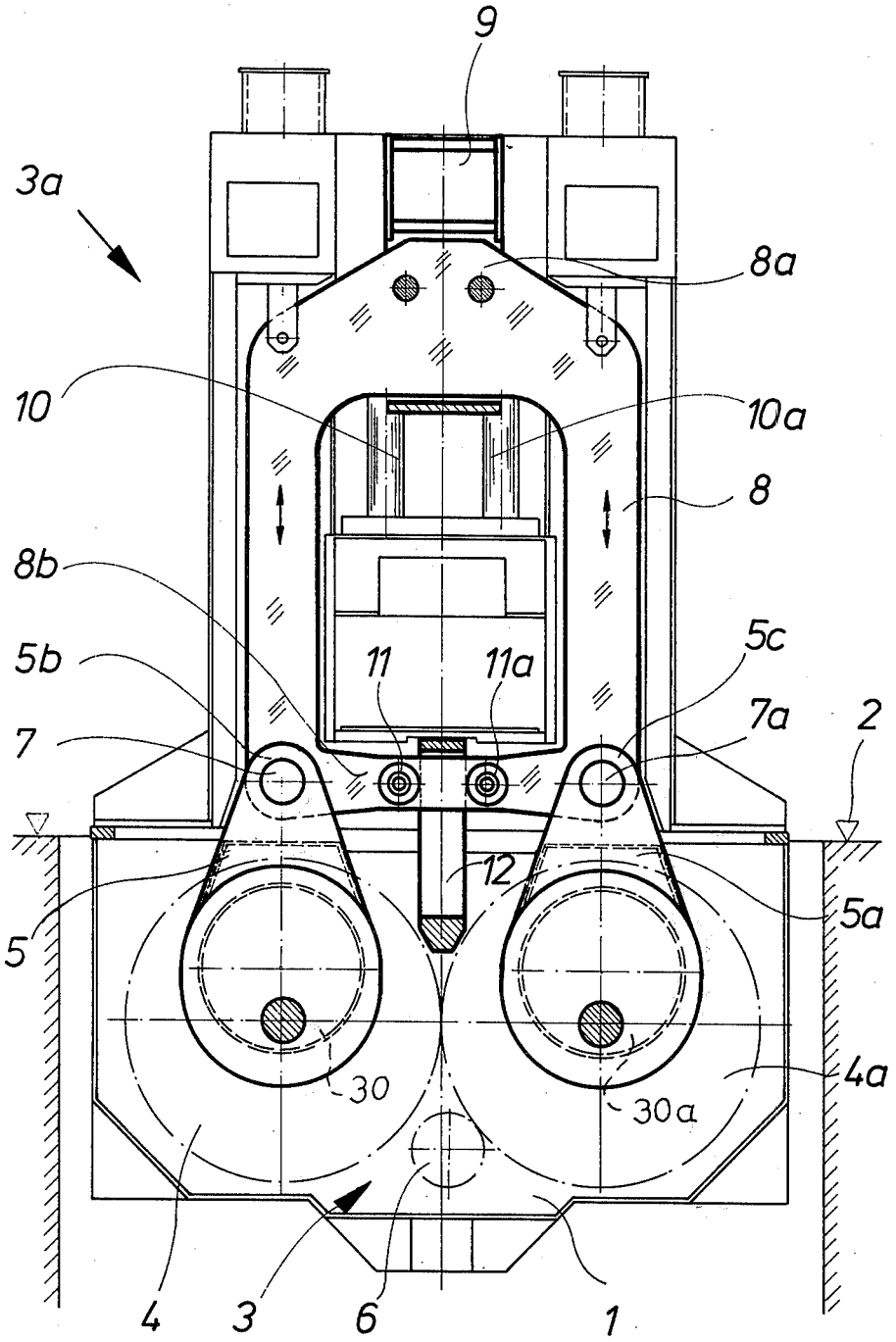
9
3a
8a
10
10a
8
8b
5c
5b
11
11a
7a
2
7
12
5a
5
4a
30
30a
4
3
6
1

PRESS FOR THE SHAPING OF SHEET METAL WITHOUT CUTTING

BACKGROUND OF THE INVENTION

1. FIELD OF THE INVENTION

This invention relates in general to the construction of presses and in particular to a new and useful press for the shaping of sheet metal without cutting which includes a crank drive which comprises crank wheels or crank shafts which rotate in respective opposite directions of rotation and which are connected to respective corners of a vertically moving press frame.

2. DESCRIPTION OF THE PRIOR ART

A press having a crank drive which includes a plunger driven by crank wheels through connecting rods and guided tie rods is known. In practice it was found a disadvantage in such a press that the horizontal force component resulting from the crank drive must always be absorbed by the tie rod guide. Another disadvantage in a known press is that the fulcrum or junction of the connecting rod and the tie rod is as a rule arranged outside the guide. This has the result that the horizontal force component exerts an undesired bending moment on the tie rod. Such negative phenomena are particular apparent in presses with a large stroke. In presses of the known type the transmission of the force to the plunger by separate independent tie rods provides no assurance for a plunger movement plane which is parallel to the table surface of the press.

SUMMARY OF THE INVENTION

The present invention provides a press for the shaping of sheet metal and similar parts without the cutting thereof and which combines a relatively large stroke and a relatively great number of strokes with a low vibration run. The construction eliminates the disadvantages of the known press and utilizes the advantages of a crank drive consisting of interlocking oppositely rotating crank wheels. With the invention the element provided between the connecting rod and the plunger comprises an enclosed yoke or frame guided in the direction of motion of the plunger.

In another embodiment of the basic construction of the invention each yoke or each frame is connected to two connecting rods. In another arrangement the yokes or frames are guided in the pivotal range of the connecting rods by two spaced axis parallel rollers arranged at respective opposite sides of a fixed member and guided therealong and carried at the bottom web of the frame or yoke.

The advantages resulting from the application of a known crank drive of two interlocking oppositely rotating crank wheels, such as the balancing of a possible unbalance of its wheels, becomes apparent with the invention only by the use of an all enclosed frame connected with two connecting rods. Of just as great an advantage however in the present invention is the exact relatively simple guidance of the frame in the direction of motion.

Accordingly it is an object of the invention to provide a press for the shaping of metal parts which includes first and second crank shafts which are each provided with a crank which is rotatable with the shaft in respective opposite directions and which are connected to respective corners of a frame member of the press which in turn is connected to a plunger which is guided for up and down movement.

A further object of the invention is to provide a crank drive for a press which includes a common drive shaft driving two crank shafts with cranks which are connected to the respective corners of a frame member guided by a plunger and which also includes a roller guide carried on the frame member between the cranks in the form of rollers which bear against respective sides of a fixed support.

A further object of the invention is to provide a press which is simple in design, rugged in construction and economical to manufacture.

The various features of novelty which characterize the invention are pointed out with particularity in th claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWING

The only FIGURE of the drawing is a partly sectional and partly elevational view of a press constructed in accordance with the invention.

GENERAL DESCRIPTION OF THE PREFERRED EMBODIMENT

Referring to the drawings in particular the invention embodied therein comprises a press for the shaping of metal sheet and similar parts without cutting and which includes a below ground casing 1 situated in a well below the floor level 2. The press comprises a crank 5 which includes a drive pinion 6 which is affixed to a drive motor (not shown). The crank drive 3 for the press **3*a* comprises interlocking crank gears or wheels 4 and 4*a* which are driven from the drive pinion 6 in respective opposite directions. The crank wheels 4 and 4*a* are contained on shafts 30 and 30*a* having crank or connecting rods 5 and 5*a* respectively. Each connecting rod 5 and 5*a* has an end 5*b* and 5*c* which is connected respectively to tie bolts 7 and 7*a* at the corners of the one end of a laterally closed yoke or frame 8. When the driving motor starts to turn the drive pinion 6, crank wheels 4 and 4*a* and the associated shafts 30 and 30*a* rotate with the connecting rods 5 and 5*a* in respective opposite directions to effect a lifting and lowering movement in the directions of the double arrows indicated on the frames. The upper end 8*a* of the yoke or frame 8 is connected with a plunger 9 of the press 3*a* which is guided for vertical upward and downward movement. The plunger column includes guides 10 and 10*a*. The lower end of the plunger 9** carries an upper die arrangement which coacts with a fixed lower die.

For the exact guidance of the frame 8 during its lifting movements guide means are provided in the pivotal range of the bolts 7 and **7*a* of the connecting rods 5 and 5*a*. The guide means includes two spaced axis parallel rollers 11 and 11*a* arranged on a bottom web 8*b* of the frame 8. The rollers bear against respective opposite sides of a stationary guideway or member 12.**

The press can be equipped both with two additional crank wheels and with two connecting rods and corresponding fulcrums and with a closed yoke, frame etc. common to these parts.

While a specific embodiment of the invention has been shown and described in detail to illustrate the application of the principles of the invention, it will be understood that the invention may be embodied otherwise without departing from such principles.

What is claimed is:

1. In a press for the shaping of metal sheet without cutting, of the type including a press plunger, driving means beneath the press, and connection means connecting the driving means to the press plunger to reciprocate the latter, with the driving means being constituted by at least two oppositely rotating crank means transmitting, through the connection means, a common rectilinear vertical reciprocation to the press plunger, the improvement comprising, in combination, connecting rods connected to said oppositely rotating crank means; at least one laterally closed press frame connected at one end to a respective pair of said connecting rods and at the other end to said press plunger, and constituting said connection means; and guide means guiding each press frame in the direction of reciprocation of said press plunger.

2. A press according to claim 1, wherein each press frame is substantially an open rectangle and includes a transversely extending bottom web pivotally connected at its opposite ends to a respective pair of said connecting rods; and a fixed, vertically extending guide member, located between said oppositely rotating crank means; said guide means comprising roller means on said transversely extending bottom web and engaged with respective opposite sides of said guide member.

3. A press according to claim 1, wherein each frame includes an end portion connected at its opposite ends to respective connecting rods.

4. A press according to claim 1, wherein said closed frame includes a transversely extending end member having opposite ends connected to respective connecting rods, said guide means being carried on said frame.

5. A press according to claim 4, wherein said guide means comprises a pair of axis parallel spaced rollers arranged on said frame end member and a fixed guide member between said rollers in rolling engagement with each of them.

* * * * *